US009480375B2

(12) United States Patent
Marshall et al.

(10) Patent No.: US 9,480,375 B2
(45) Date of Patent: Nov. 1, 2016

(54) AEROACOUSTIC DUSTER

(71) Applicants: Jeffrey S. Marshall, Jericho, VT (US); Darren Hitt, Jericho, VT (US); Jun-ru Wu, South Burlington, VT (US); Nicholas M. Vachon, Newport, VT (US); Di Chen, Colchester, VT (US)

(72) Inventors: Jeffrey S. Marshall, Jericho, VT (US); Darren Hitt, Jericho, VT (US); Jun-ru Wu, South Burlington, VT (US); Nicholas M. Vachon, Newport, VT (US); Di Chen, Colchester, VT (US)

(73) Assignee: The University of Vermont & State Agricultural College, Burlington, VT (US)

( * ) Notice: Subject to any disclaimer, the term of this patent is extended or adjusted under 35 U.S.C. 154(b) by 452 days.

(21) Appl. No.: 14/191,299

(22) Filed: Feb. 26, 2014

(65) Prior Publication Data

US 2014/0289997 A1 Oct. 2, 2014

Related U.S. Application Data

(63) Continuation-in-part of application No. 13/024,072, filed on Feb. 9, 2011, now Pat. No. 8,695,156.

(51) Int. Cl.
*A47L 9/02* (2006.01)
*A47L 9/08* (2006.01)

(52) U.S. Cl.
CPC ... *A47L 9/02* (2013.01); *A47L 9/08* (2013.01)

(58) Field of Classification Search
CPC ..... A47L 9/02; A47L 9/08; G01N 27/622; G01N 33/0057
USPC ..... 15/339, 415.1
See application file for complete search history.

(56) References Cited

U.S. PATENT DOCUMENTS 6,828,795 B2 * 12/2004 Krasnobaev ..... G01N 27/622 324/464

* cited by examiner

*Primary Examiner* — Joseph J Hail
*Assistant Examiner* — Marc Carlson
(74) *Attorney, Agent, or Firm* — K. P. Correll & Associates, LLC

(57) ABSTRACT

The invention disclosed herein provides for high particle removal rate and/or heat transfer from surfaces. The device removes particulate matter from a surface using a bounded vortex generated over the surface, with suction in the vortex center and jets for blowing air along the periphery. The jets are tilted in the tangential direction to induce vortex motion within the suction region. The vortex is said to be bounded because streamlines originating in the downward jets are entrained back into the central vortex.

9 Claims, 10 Drawing Sheets

AEROACOUSTIC DUSTER

REFERENCE TO U.S. GOVERNMENT INTEREST

"The U.S. Government has a paid-up license in this invention and the right, in limited circumstances to require the patent owner to license others on reasonable terms as provided for by the terms of Grant NNX08AZ07A awarded by NASA."

CROSS-REFERENCE TO RELATED APPLICATIONS

The present application is related to, claims the earliest available effective filing date(s) from, and incorporates by reference in its entirety all subject matter of the following listed application(s) (the "Related Applications") to the extent such subject matter is not inconsistent herewith; and the present application also claims the earliest available effective filing date(s) from, and also incorporates by reference in its entirety all subject matter of any and all parent, grandparent, great-grandparent, etc. applications of the Related Application(s) to the extent such subject matter is not inconsistent herewith:

1. U.S. patent application Ser. No. 13/024,072, entitled "Aeroacoustic Duster", naming Jeff Marshall, Darren Hitt, Jun-ru Wu, Nick Vachon, and Di Chen as inventors, filed 2 Feb. 2011.

BACKGROUND

1. Field of Use

These teachings relate generally to a system and method for high particle removal rate from surfaces with low energy expenditure. More specifically, these teachings relate to all normal bounded vortex for creating, a high shear stress vortex for high particle removal rates. In addition, the use of 'bound vortex' impingement is shown to provide intense, localized, and well controlled heat and mass transfer enhancement.

2. Description of Prior Art (Background)

Conventional vacuum cleaners make a relatively high impact contact with the surface being cleaned. Hence, conventional vacuum cleaners cause considerable surface wear. In addition, conventional vacuum cleaners and brushes have recently been cited as a source of bacteria breeding areas. Therefore, there exists a need for dust mitigation in residential and industrial applications subject to dust build-up, or for applications for optical materials or delicate electronic instrumentation for which surface contact is undesirable.

In addition, air jet impingement is widely used to enhance heating, cooling, and drying processes. The procedure provides the heat transfer rates required to anneal metal and plastic sheets, temper glass, and cool turbine blades and electrical components. Air jet impingement also facilitates the required mass transfer to dry paper, textile, veneer, and film materials. Thus, an improved heating, cooling, and drying process provides the possibility of increased manufacturing productivity and production quality.

BRIEF SUMMARY

The foregoing and other problems are overcome, and other advantages are realized, in accordance with the presently preferred embodiments of these teachings. The aeroacoustic duster device is intended to provide for high particle removal rate from surfaces with low energy expenditure relative to competing vacuum-based devices. The device removes particulate matter from a surface using a wall normal standing vortex. The wall normal standing vortex is generated over the surface, with suction in the vortex center and jets for blowing air along the periphery. The jets are tilted in the tangential direction to induce vortex motion within the suction region. The vortex is said to be bonded, or wall normal, because streamlines originating in the jets are entrained back into the central vortex. The wall normal vortex acts to enhance shear stress under the suction region, hence increasing the ability of the air flow to entrain particles.

Acoustic radiation force may be used to levitate dust particles and break their adhesive bonds.

In accordance with one embodiment of the present invention an apparatus for efficiently removing dust particles is provided. The apparatus includes bounded vortex generator for generating, a wall normal standing vortex. The bounded vortex generator includes a plurality of tilted jets for providing tangential air flow across a dusted substrate, and a vacuum port for vacuuming dust excited by the tangential air flow combination.

The invention is also directed towards a system for removing dust particles. The system may include a tweeter having an acoustic generator for generating sound waves. The acoustic generator includes at least one continuous wave (CW) acoustic generator and at least one frequency modulated (FM) acoustic generator. The system also includes a bounded vortex generator coupled to the tweeter. The tweeter includes an acoustic emitter for emitting acoustic energy; a vacuum port for removing dust; and a plurality of tilted jets surrounding the acoustic emitter for providing a tangential air flow to a surface.

The invention is also directed towards an apparatus for efficiently removing dust particles from a surface without direct contact. The apparatus includes a plurality of tilted annular jets arranged around a common axis for providing an air flow substantially tangential to the surface and a circular vacuum port for providing dust removing, suction. The circular vacuum port suction and the plurality of tilted annular jets are adaptable to operate conjunctively to form a standing vortex with a high shear stress region tangential to the surface to efficiently remove the dust particles. The apparatus also includes an impingement surface parallel to the surface to be cleaned, wherein the impingement surface is separated from the surface to be cleaned by a predetermined distance.

The invention is also directed towards an apparatus for efficiently impinging fluid onto a surface to remove particles and/or heat from the surface, the apparatus includes a plurality of tilted annular jets arranged around a common axis for providing a radial and tangential air flow component, wherein each tilted annular jet comprises a tilt angle with respect to a standing vortex and wherein each tilt angle is proportional with the flow rate ratio. The apparatus also includes a circular vacuum port for providing negative air pressure. The circular vacuum port suction and the plurality of tilted annular jets are adaptable to operate conjunctively to form a standing vortex with a high shear stress region tangential to the surface to efficiently remove the dust particles and/or maximize heat transfer away from the surface.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

The following brief definition of terms shall apply throughout the application:

The term "comprising" means including but not limited, to, and should be interpreted in the manner it is typically used in the patent context;

The phrases "in one embodiment," "according to one embodiment," and the like generally mean that the particular feature, structure, or characteristic following, the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example; and If the specification states a component or feature "may" "can," "could," "should," "preferably," "possibly," "typically," "optionally," "for example," or "might" (or other such language) be included or have a characteristic, that particular component or feature is not required to be included or to have the characteristic.

Figure 1:
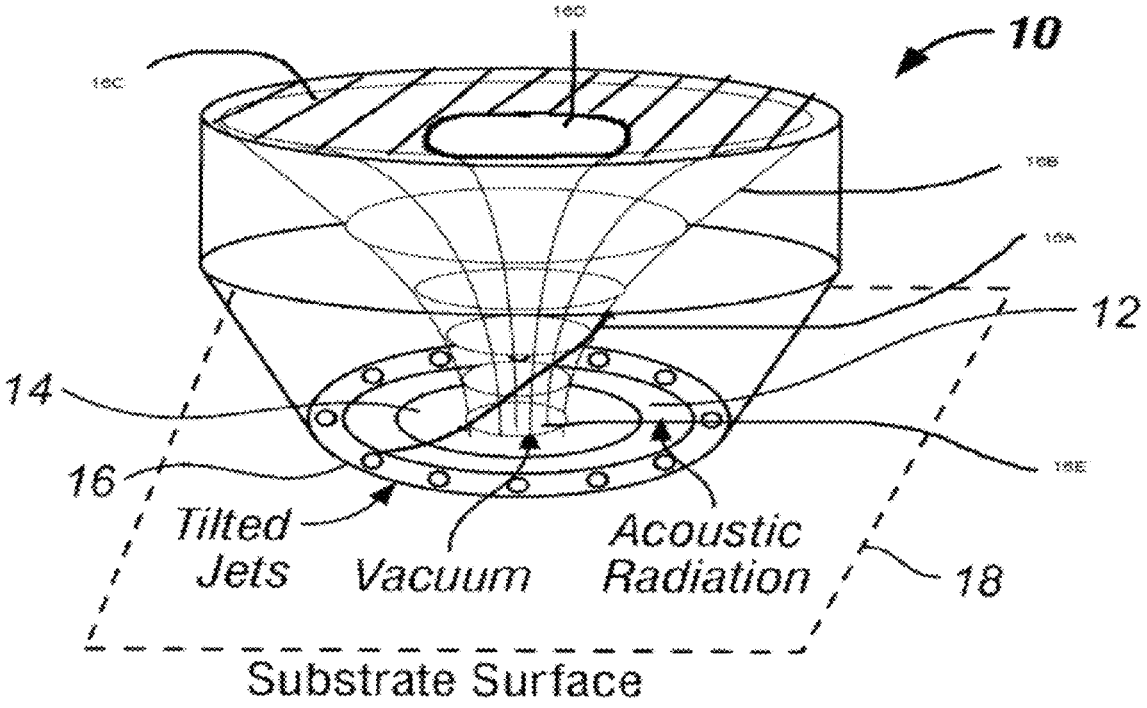
FIG. 1 is a pictorial illustration of one embodiment of the present non-contact aero acoustic duster invention.

Referring to FIG. 1 there is shown a pictorial illustration of one embodiment of the present non-contact aero-acoustic duster invention. The duster 10 is suspended about 1 cm above a surface 18. The underside of the duster has three active regions: suction port 14; acoustic emitter 12; and tilted jets 16, each of which is of the form of tangential concentric bands or regions as shown in FIG. 1. The centermost region, the suction region 14, leads to a filter similar to that used in traditional vacuum cleaners. The second region, is the optional acoustic emitter 12 for emitting acoustic radiation at the surface. The third region consists of N tangentially-oriented jets 16, which draw air from the filter exhaust and create a bounded vortex 16B with suction in the center of the suction port 14. The vortex 16B is "bounded" by stream lines 16A emanating from jets 16. It will be understood that for clarity only one streamline 16A is shown. Furthermore, vortex 16B is also fixed in height by the distance between the surface 18 and the confinement surface 16C.

The aero-acoustic duster 10 can be used in the same manner that a vacuum cleaner is used, ranging from small hand-held devices to larger-push-type devices. It may also be incorporated in a mechanical translation device (e.g., arm) to allow for automated cleaning. Unlike conventional vacuum cleaners, the aero-acoustic duster makes no contact with the surface being cleaned. Hence, the aero-acoustic duster 10 does not cause surface wear and is suitable for use on all types of surfaces. The latter fact will make this device particularly useful for dust mitigation in industrial applications subject to dust build-up, or for applications for optical materials or delicate electronic instrumentation for which contact is undesirable.

Vortex Optimization:

The bounded vortex generation device 16 is optimized to provide a strong wall normal standing vortex flow with optimal surface shear stress. Numerical simulations using the computational fluid dynamics software FLUENT to generate the air flow with different number of jets and jet orientations and with different operating pressure differentials.

The number of jets and jet tilt angles that provide the maximum shear stress on the substrate surface, which in turn provides the optimal entrainment of particles from the surface, is determined initially from numerical simulations using computational fluid dynamics software. However, it will be appreciated that any suitable number of jets and jet tilt angles that provide the maximum shear stress on the substrate surface, which in turn provides the optimal entrainment of particles from the surface, may be used.

Still referring to FIG. 1, a notable feature is the tilting of the annular jets 16 in the azimuthal direction, which is necessary for generation of the wall-normal vortex. For low values of the ratio between the outlet flow rate and the inlet flow rate, the streamlines 16A originating from the jet 16 inlet proceed to the boundary layer along the surface 18. By contrast, at high values of flow rate ratio, the jet stream 16A quickly bends inwards and is entrained into the suction outlet 16E without significantly influencing; the flow near the surface 18.

Figure 2A:
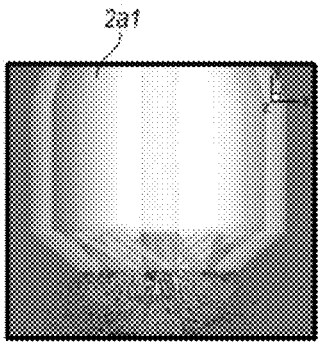
FIG. 2A is an illustration of a computed flow field generated by bound vortex device in accordance with the invention shown in FIG. 1.
Figure 2B:
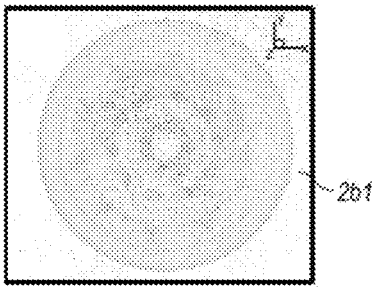
FIG. 2B is an illustration of the computed flow field corresponding vectors in a horizontal plane generated in accordance with the invention shown in FIG. 1.
Figure 2C:
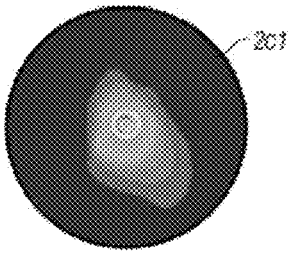
FIG. 2C is an illustration of the corresponding surface shear stress field in accordance with the invention shown in FIG. 1.
Figure 3A:
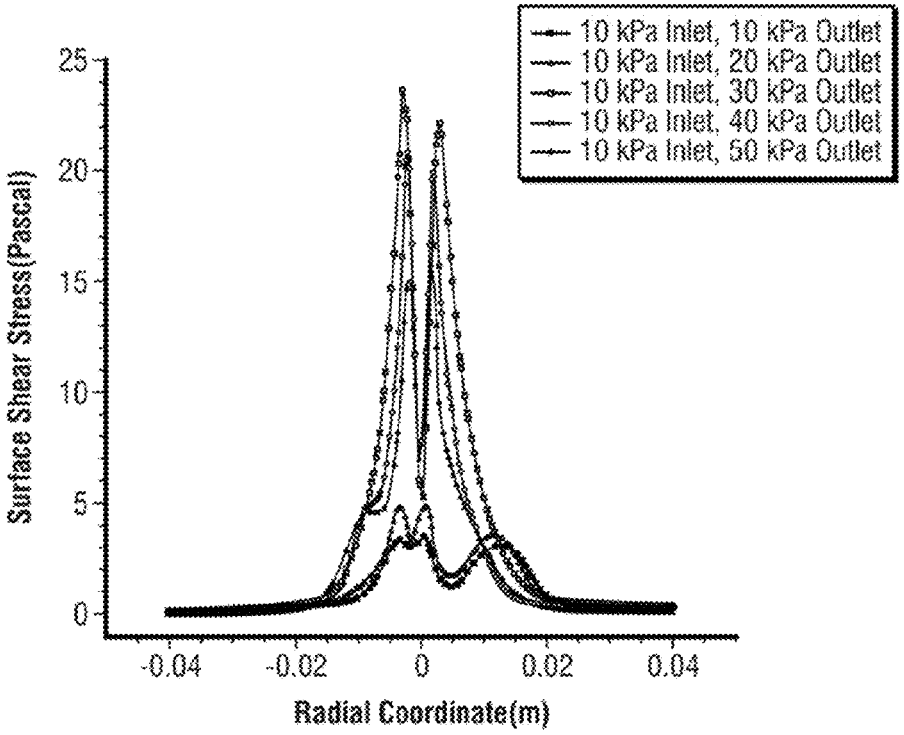
FIG. 3A is a graph of profiles of surface shear stress generated by bounded vortex device in accordance with the invention shown in FIG. 1.
Figure 3B:
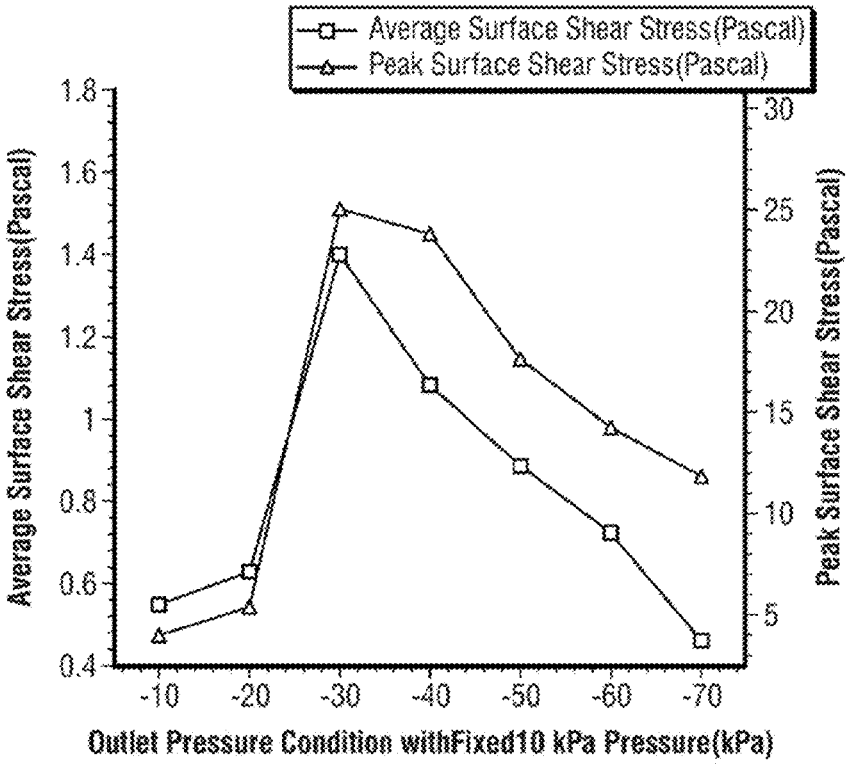
FIG. 3B is a line plot of maximum and average shear stress as function of outlet pressure in accordance with the invention shown in FIG. 1.
Figure 4B:
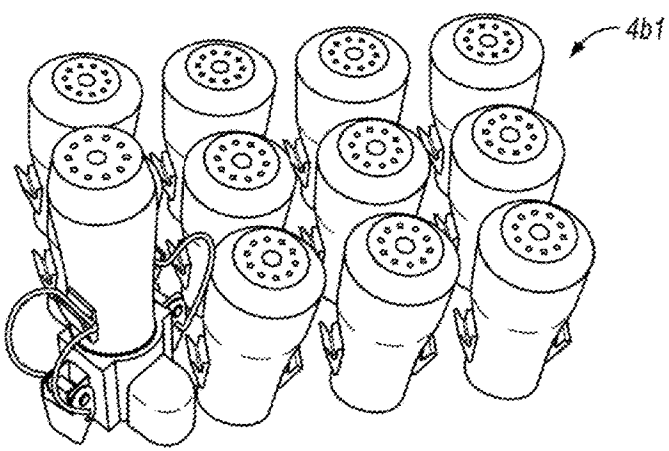
FIG. 4B is a schematic of a set of 12 prototype devices used for testing in accordance with the invention shown in FIG. 1.

Plots of the flow field and substrate surface shear stress at the optimal condition are shown in FIGS. 2A, 2B, and 2C. Referring also to FIG. 3A, there is shown a graph of profiles of surface shear stress generated by bounded vortex device in accordance with the invention shown in FIG. 1. Also referring to FIG. 3B, there is shown a line plot of maximum and average shear stress as function of outlet pressure in accordance with the invention shown in FIG. 1. Twelve prototypes 4*b*1 of the bounded vortex generators are shown in FIG. 4*b*, each with different N tangentially-oriented jets 16 (see FIG. 1).

Figure 4A:
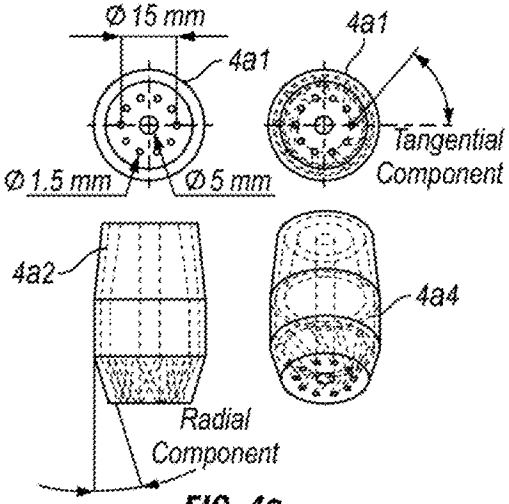
FIG. 4A is a schematic diagram of a bounded vortex, device in accordance with the invention shown in FIG. 1.

Referring also to FIG. 4A there is shown a schematic diagram of a wall normal standing vortex generator in accordance with the invention shown in FIG. 1. Still referring to FIG. 4*a*, vortex lines 4*a*2 show relative airflow within vortex generator outer shell 4*a*1. It will be appreciated that the bounded vortex generator outer shell 4*a*1 may be any suitable material. It will also be appreciated that the internal structure represented by 4*a*4 may be any suitable internal structure. Finally, it will be understood, that the measurements shown in FIG. 4*a* are representative and should not be construed as limiting in any manner.

Still referring to FIG. 4*a* it will be understood that tilted jets 16 may be tilted to any suitable angle to maximize shear stress on surface 18. For example, tilted jets 16 may be tilted to provide 60 degrees tangential component and 15 degrees radial component.

Acoustic Radiation Optimization

Figure 5C:
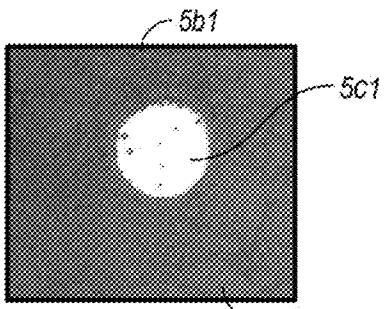
FIGS. 5A-5C are schematics of aerodynamic test set-up and results for bounded vortex device using lunar stimulant in accordance with the invention shown in FIG. 1.
Figure 5B:
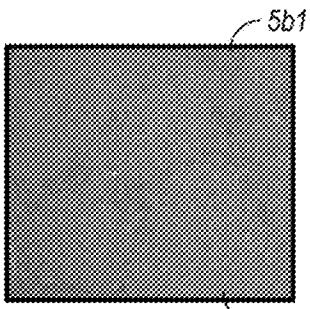
Figure 5A:
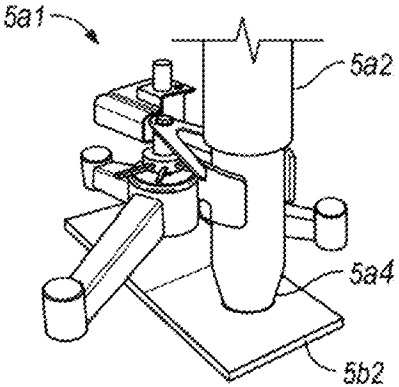

Referring also to FIG. 5A there is shown a schematics of aerodynamic test set-up 5*a*1 for bounded vortex generation device 5*a*4 and tweeter 5*a*2. It will be understood that tweeter 5*a*2 may be any suitable acoustic generator.

FIG. 5B shows a Plexiglas substrate 5*b*1 uniformly covered with simulated lunar dust 5*b*2. FIG. 5C shows result for bounded, or wall normal standing vortex device in accordance with the invention shown in FIG. 1.

Still referring to FIG. 5C; an air cross-flow was introduced to blow the particles off of the Plexiglas substrate 5*b*1 once the particles are acoustically levitated. The result shows nearly 100% particle removal from the area 5*c*1 where the particles were subjected to both the acoustic levitation and the air cross-flow.

Figure 6:
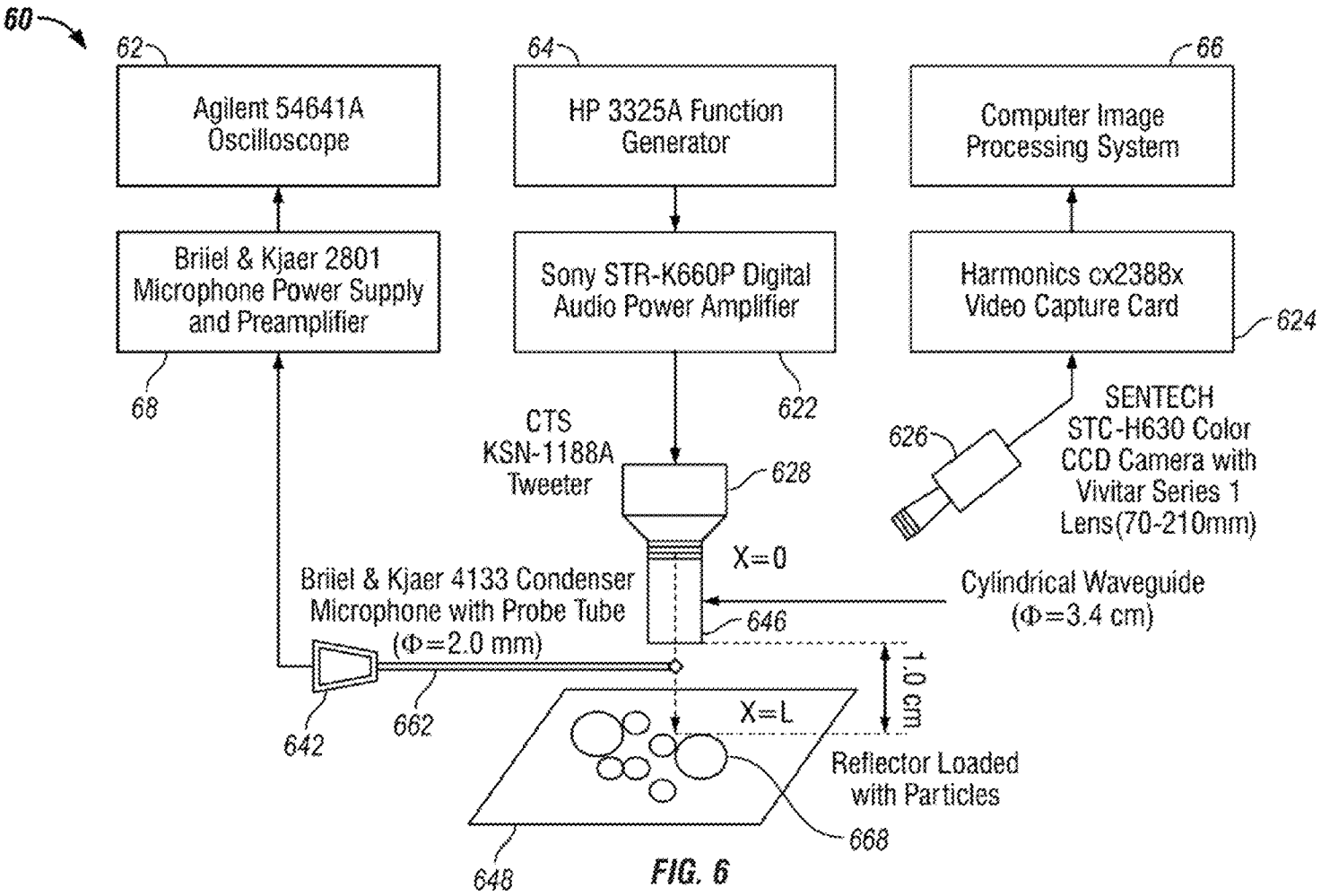
FIG. 6 is a block diagram of an experimental configuration for testing, particle levitation by acoustic radiation emitted normal to a surface in accordance with the invention shown in FIG. 1.
Figure 7A:
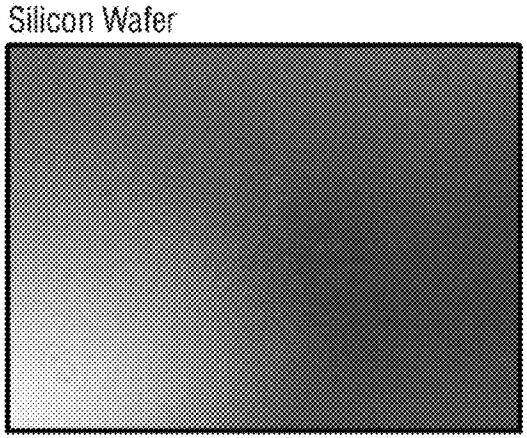
FIGS. 7A-7D are pictorial illustrations of four reflector surfaces used to validate the performance of the present invention shown in FIG. 1 silicon wafer (FIG. 7A), commercial solar panel (FIG. 7B), synthetic leather (FIG. 7C) and Teflon (FIG. 7D), respectively.
Figure 7B:
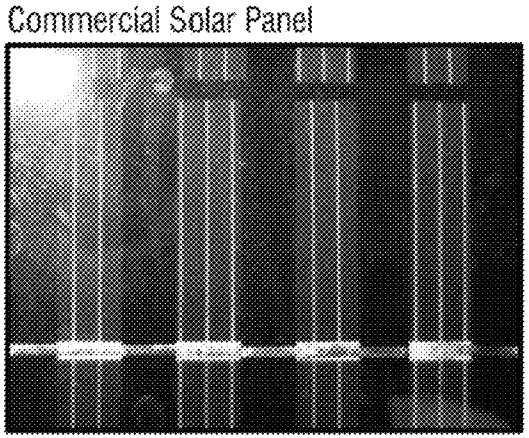
Figure 7C:
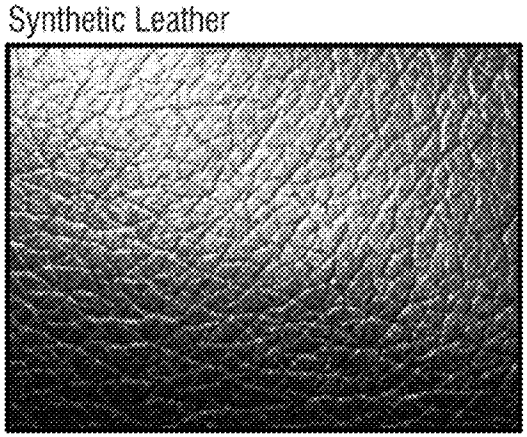
Figure 7D:
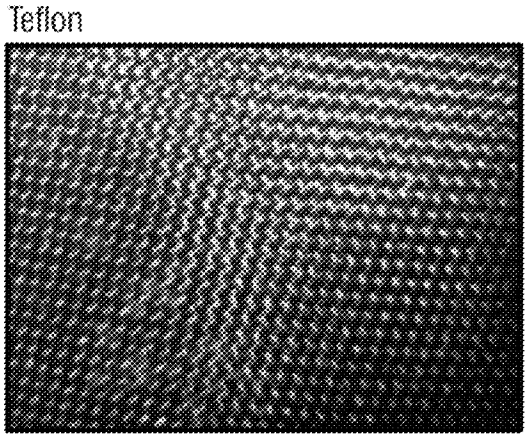
Figure 8A:
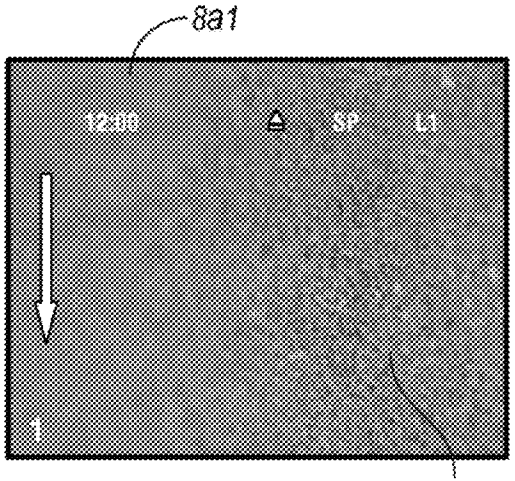
FIGS. 8A-8F are pictorial illustrations of a sequence of particle removal of Mars dust stimulants lodged on a silicon wafer in accordance with the present invention shown in FIG. 1.
Figure 8B:
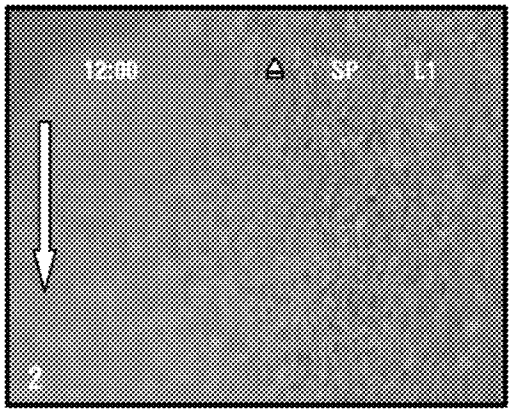
Figure 8C:
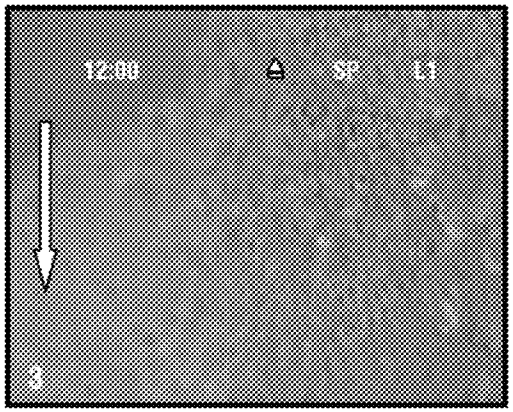
Figure 8D:
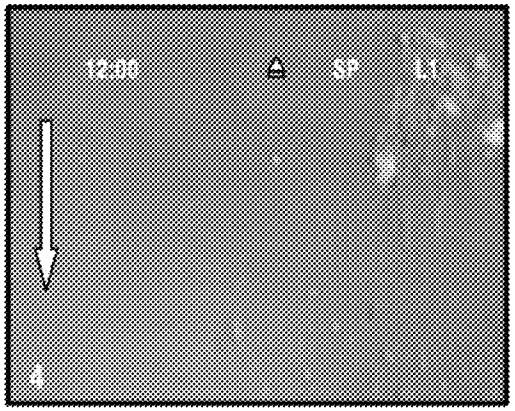
Figure 8E:
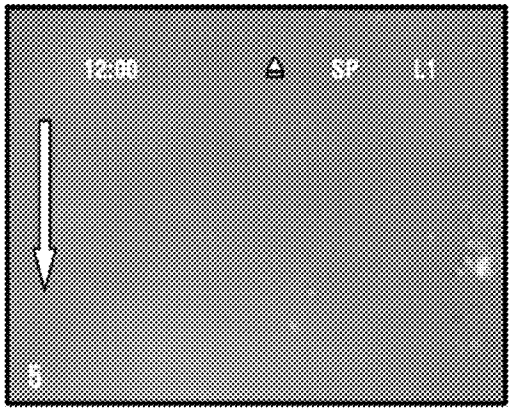
Figure 8F:
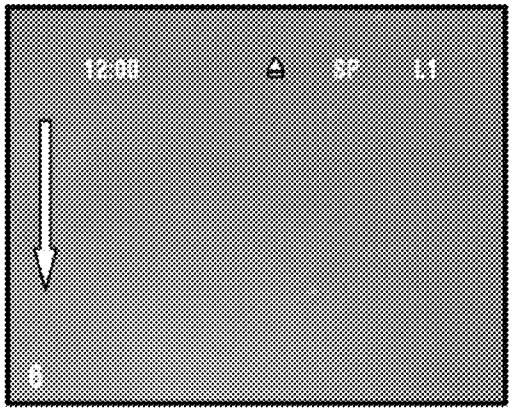

Referring also to FIG. 6 there is shown a block diagram of an experimental configuration for testing particle levitation by acoustic radiation emitted normal to a surface in accordance with the invention shown in FIG. 1. The experimental configuration included an oscilloscope 62, a microphone power supply and pre-amplifier 68, a microphone 642, a probe tube 662, a function generator 64, an audio power amplifier 622, a computer processing imaging system, a video capture card 624, and a CCD camera 626. A weak air cross-flow was introduced to blow the particles 668 off of the test surface 648 once the particles were levitated by tweeter 628 and waveguide 646, respectively. The tests were conducted for both Martian and simulated lunar dust composed of dry particles with diameter ranging from 1-100 mm.

Referring also to FIGS. 7A-7D there are shown pictorial illustrations of four reflector surfaces used to validate the performance of the present invention shown in FIG. 1: silicon wafer (FIG. 7A), commercial solar panel (FIG. 7B), synthetic leather (FIG. 7C) and Teflon (FIG. 7D), respectively. All parameters including L (see FIG. 6), frequency and acoustic intensity were kept the same for all four materials. Each reflector was exposed to the acoustic excitation and air flow for 90 seconds during, the removal operation. Size distributions of the residual particles after removal on the reflectors were studied by direct counting.

Referring also to FIGS. 8A-8F there are shown pictorial illustrations of a sequence of particle removal of Mars dust stimulants 8*a*1, 8*a*2 lodged on a silicon wafer in accordance with the present invention shown in FIG. 1. FIGS. 8A-8F contains 6 images taken in sequence when silicon wafer was chosen as the reflector. The arrow represents the air flow direction. Air flow was continuously on for all 6 images were taken and acoustic signal was continuously turned on starting at images 2, FIG. 8*b*. There was no particles' movement at the time when image 1, FIG. 8*a* was taken when only airflow was on. Particles began to be removed as soon as the tweeter (FIG. 6, item 628) was turned on as shown in images 2-6. It will be appreciated that Mars dust simulants were removed effectively by the air flow after the dust simulants were levitated by the standing wave acoustic field.

Figure 9A:
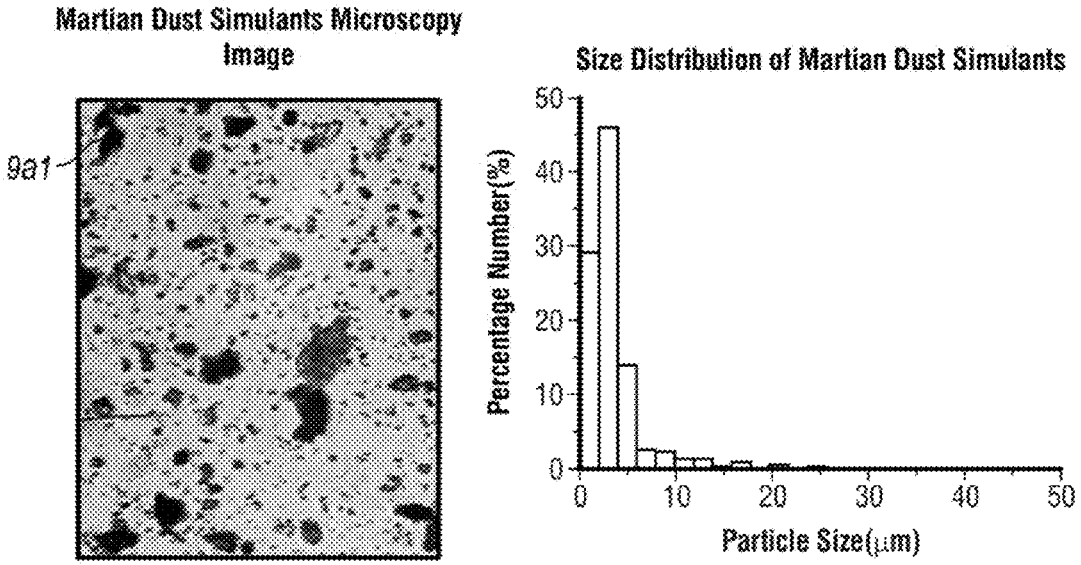
FIG. 9A is a pictorial illustration of images of Mars dust stimulants accompanied with the percent-number size-distribution histogram.
Figure 9B:
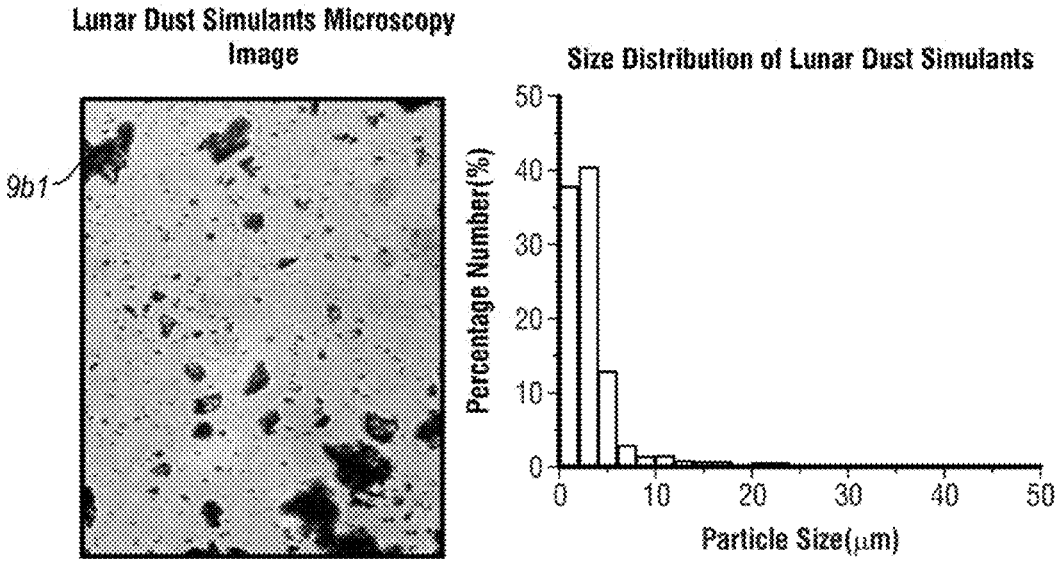
FIG. 9B is a pictorial illustration of images of Lunar dust stimulants accompanied by the percent-number size-distribution histogram.

Referring also to FIG. 9A there is shown a pictorial illustration of images of Mars dust stimulants accompanied with the percent-number size-distribution histogram. Likewise, also referring to FIG. 9B is a pictorial illustration of images of Lunar dust stimulants accompanied by the percent-number size-distribution histogram; The histograms of Mars and lunar dust simulants indicate that they both have a large component of particles with diameter less than 6 μm, especially in the 2-4 μm range. The percent-number of Mars dust stimulants for >4 μm is about 25% and that for 2 μm<particle-size <4 μm is about 45%. The lunar dust simulant has a similar percent-number (12% vs 14%) as the Mars dust simulant in the size range >4 μm, a lower percent number (40% vs 45%) in the size range 2 μm-4 μm, and it has more particles in the range <2 μm (38%) than Martian dust simulant has (29%).

Figure 10A:
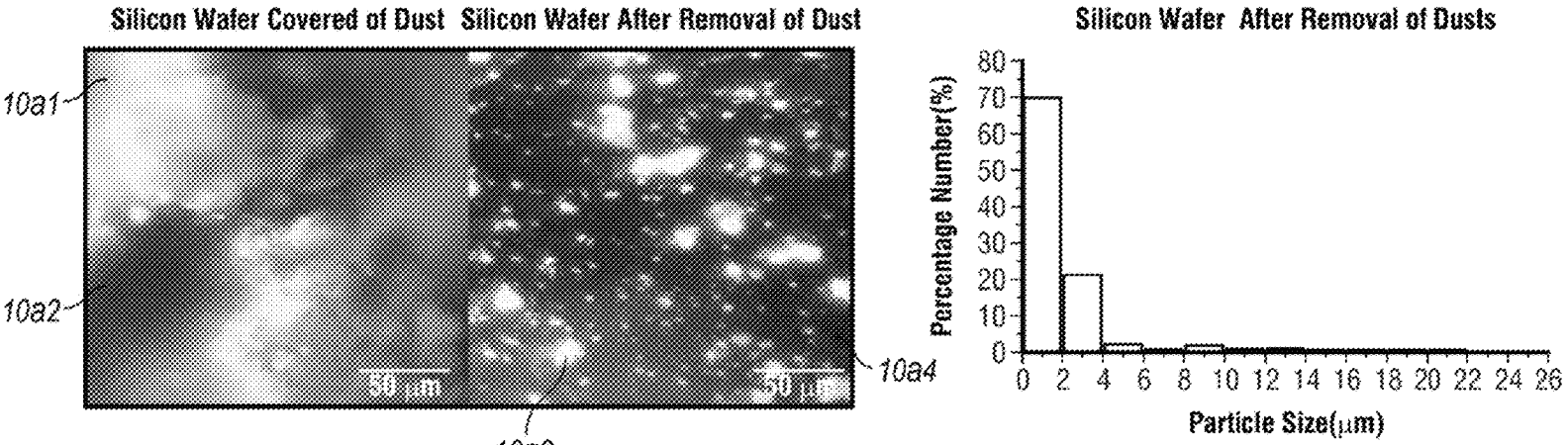
FIG. 10A is a pictorial illustration of images of dust particle removal efficiency accompanied by the percent-number size-distribution histogram for silicon wafer in accordance with the present invention shown in FIG. 1.
Figure 10B:
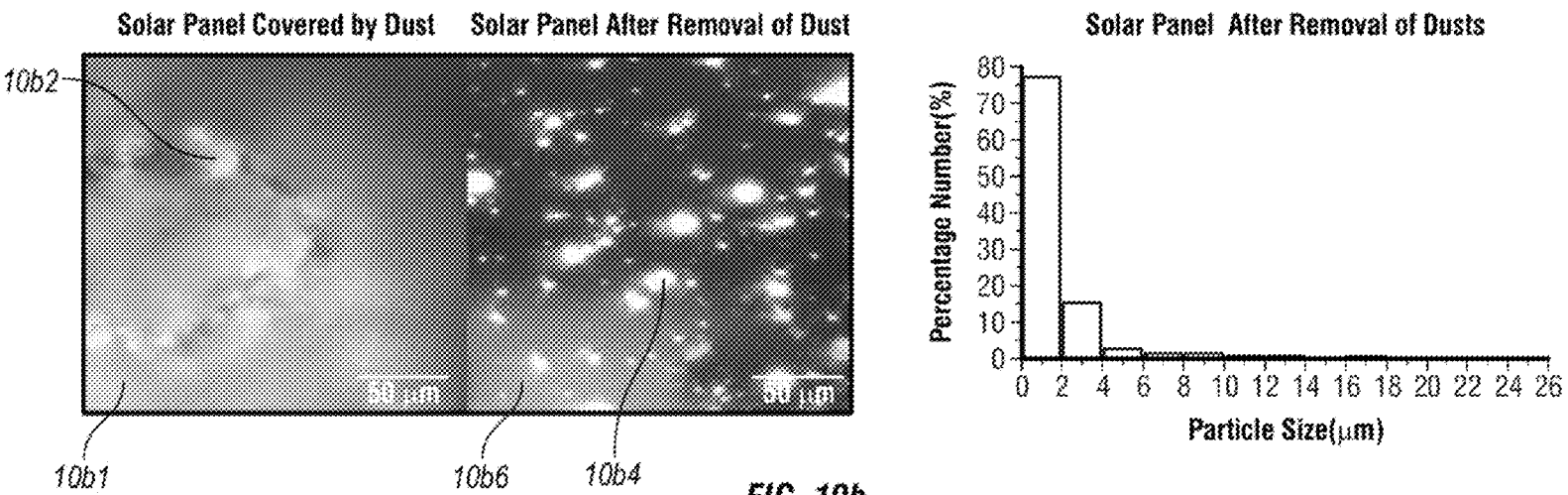
FIG. 10B is a pictorial illustration of images of dust particle removal efficiency accompanied by the percent-number size-distribution histogram for solar panel in accordance with the present invention shown in FIG. 1.
Figure 10C:
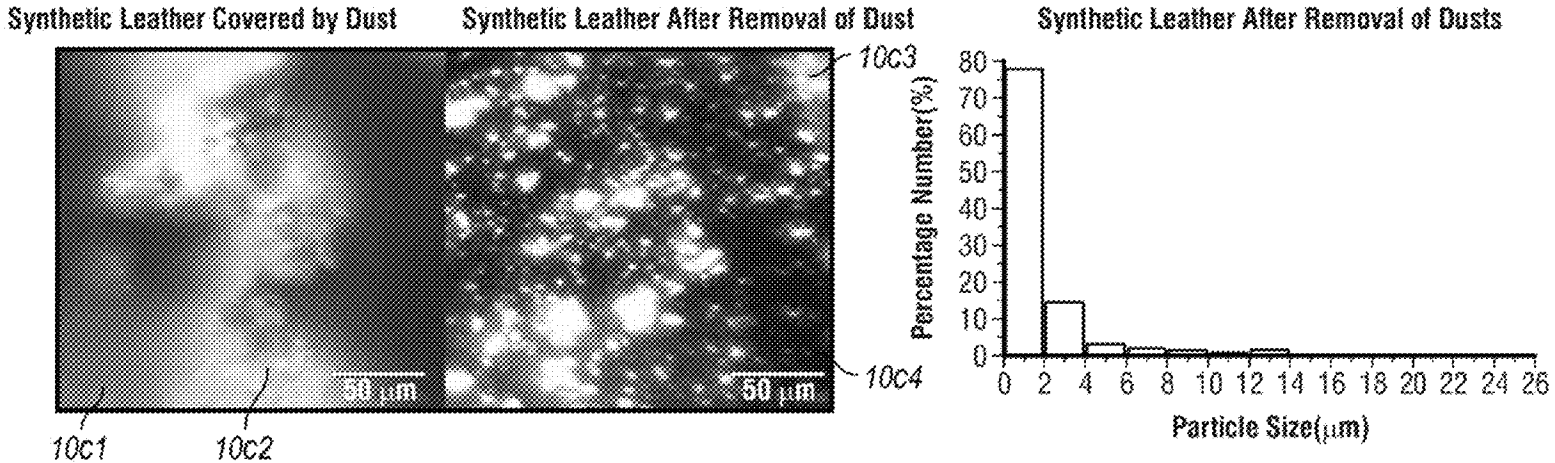
FIG. 10C is a pictorial illustration of images of dust particle removal efficiency accompanied by the percent-number size-distribution histogram for synthetic leather in accordance with the present invention shown in FIG. 1.
Figure 10D:
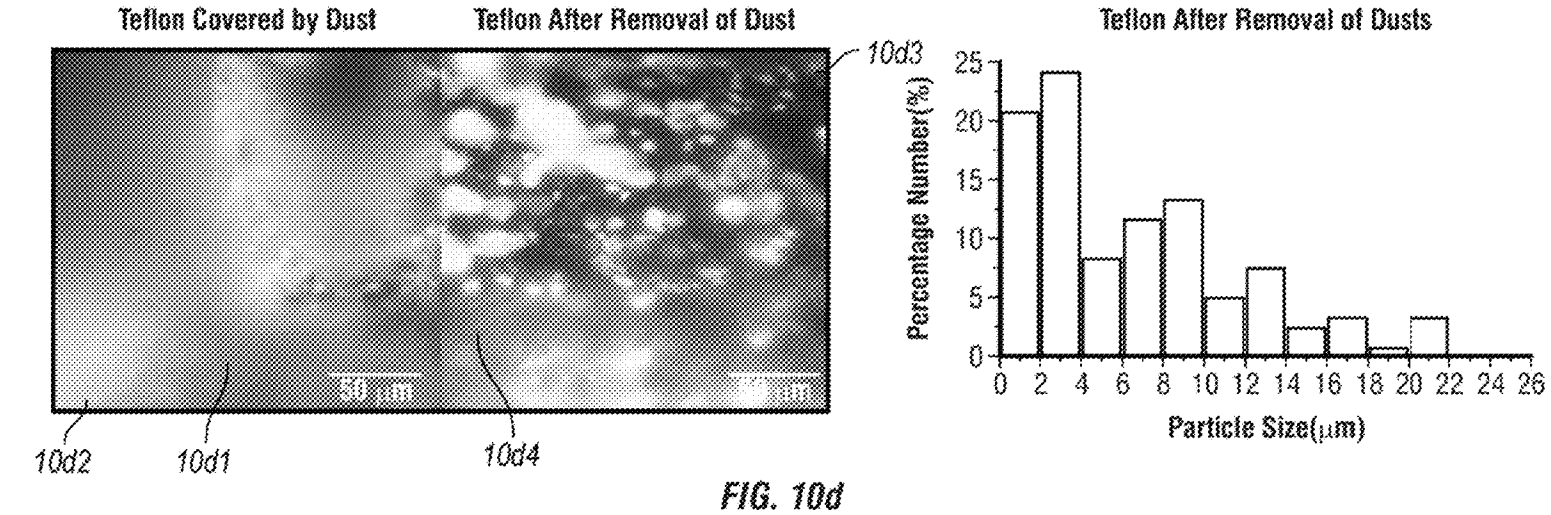
FIG. 10D is a pictorial illustration of images of dust particle removal efficiency accompanied by the percent-number size-distribution histogram for Teflon in accordance with the present invention shown in FIG. 1.

Referring also to FIG. 10A, FIG. 10B, FIG. 10C, and FIG. 10D, there is shown a pictorial illustration of images of dust particle removal efficiency accompanied by the percent-number size-distribution histogram for silicon wafer, solar panel, synthetic leather, and Teflon, respectively, in accordance with the present invention shown in FIG. 1. As shown, there are 3 panels, for each of FIG. 10A-D; the first two are photos of a reflector covered by Mars dust simulant taken under the microscope before and after the dust-simulants removal operation by air flow and acoustic standing wave, the third panel on the right is the size distribution histogram of the particles residual on the reflector after the removal procedure. Few particles larger than 4 μm were left (from more than 25% before the operation to less than 9% after the operation) on the silicon wafer, solar panel and synthetic leather after the removing operation as shown in FIG. 10A-C. Particle-number in the range of 2-4 μm was also dramatically reduced from 46% to around 20% on silicon wafer and 15% on the solar-panel and leather surfaces. Small particles whose size was less than 2 μm dominated in the residuals.

Figure 11:
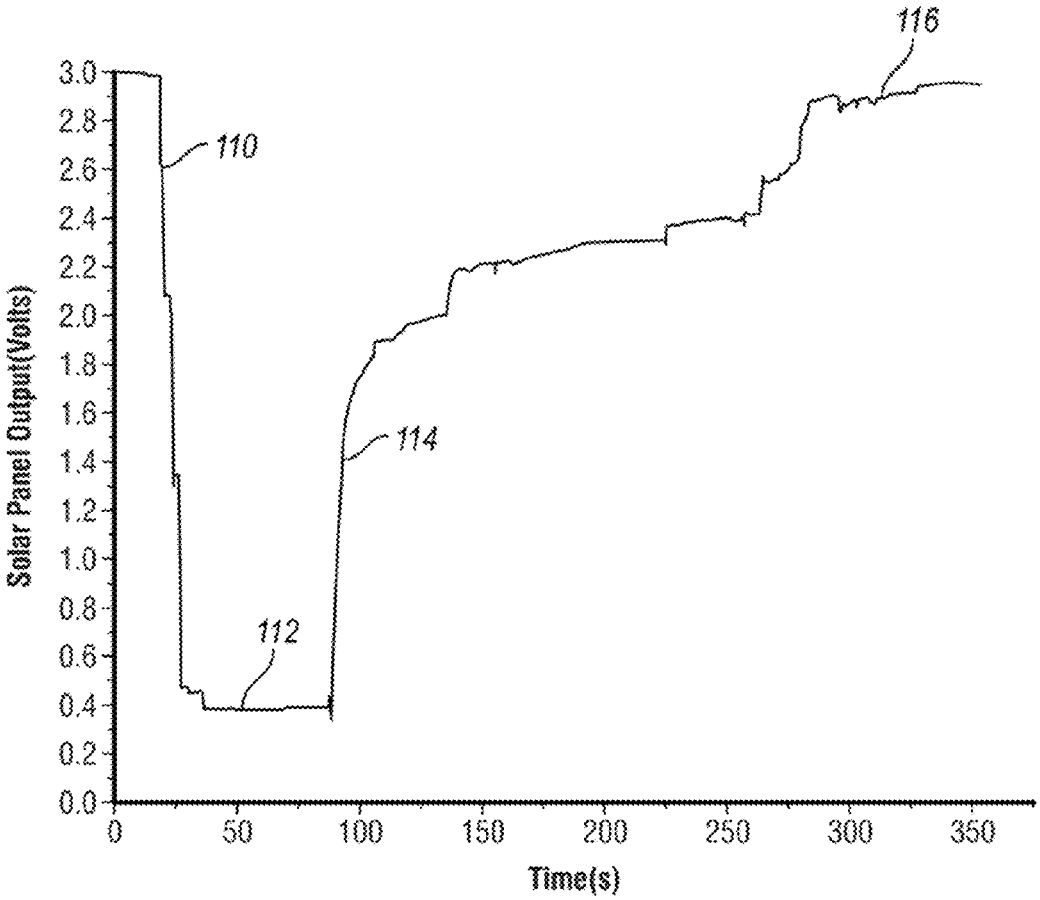
FIG. 11 is a graph of solar panel voltage output versus time as dust is removed in accordance with the present invention shown in FIG. 1.

Referring also to FIG. 11 there is shown a graph of solar panel voltage output versus time as dust is removed in accordance with the present invention shown in FIG. 1. The graph reflects the solar panel voltage output changed with time as the Mars dust simulants were sprayed on the surface and gradually removed from it by the combination of acoustic standing wave effect and airflow method. There was a significant drop in solar panel output voltage 110 (below 15% of its initial voltage of 3 V) due to the deposition and coverage of Mars dust simulants. The output voltage remained constant 112 in time until the air flow and acoustic field were applied at t−90 s. The output-voltage of the solar panel restored quickly to 65% of 3 V in first 20 seconds 114, then increased gradually up to 98.4% 116 after 4 minutes It should be understood that the foregoing description is only illustrative of the invention. For example, optional tweeter **5*a*2 shown in FIG. 5*a*** may be one or more suitable acoustic generators for generating continuous wave (CW) acoustic signals at multiple frequencies and amplitudes, generating frequency modulated (FM) acoustic signals at multiple frequencies and amplitudes, or a combination of CW and FM acoustic signals for specified time intervals.

Similarly, wall normal standing vortex generator **5*a*4 shown in FIG. 5*a*** may include variable air flow generator and adjustable air flow jets. Thus, various alternatives and modifications can be devised by those skilled in the art without departing from the invention. Accordingly, the present invention is intended to embrace all such alternatives, modifications and variances that fall within the scope of the appended claims.

The invention claimed is:

1. An apparatus for efficiently removing dust particles from a surface without direct contact, the apparatus comprising:

a plurality of tilted annular jets arranged around a common axis providing a radial and a tangential air flow component for providing an air flow substantially tangential to the surface, a circular vacuum port for providing dust removing suction; and wherein the circular vacuum port suction and the plurality of tilted annular jets are oriented at an acute radial angle relative to the common axis to induce a standing vortex with a high shear stress region tangential to the surface to efficiently remove the dust particles; and an impingement surface parallel to the surface, wherein the impingement surface is separated from the surface by a predetermined distance.

2. The apparatus as in claim 1 further comprising an acoustic emitter arranged to radiate acoustic waves normal to the surface below the circular vacuum port to disrupt adhesive bonding between the dust particles and the surface.

3. The apparatus as in claim 1, wherein each tilted annular jet comprises a tilt angle with respect to the vortex.

4. The apparatus as in claim 1 wherein the vortex is bounded by streamlines emanating from the plurality of annular tilted jets.

5. The apparatus as in claim 4 wherein the vortex is further bounded by the predetermined separation distance between the surface and impingement surface.

6. An apparatus for efficiently removing dust particles from a surface without direct contact, the apparatus comprising:

a plurality of tilted annular jets arranged around a common axis providing a radial and a tangential air flow component for providing an air flow substantially tangential to the surface, wherein each tilted annular jet comprises a tilt angle with respect to a standing vortex and wherein each tilt angle is set based on a predetermined flow rate ratio;

a circular vacuum port for providing dust removing suction; and wherein the circular vacuum port suction and the plurality of tilted annular jets are oriented at an acute radial angle relative to the common axis to induce the standing vortex with a high shear stress region tangential to the surface to efficiently remove the dust particles; wherein the vortex is bounded by streamlines emanating from the plurality of annular tilted jets; and a confinement surface parallel to the surface, wherein the confinement surface is separated from the surface by a predetermined distance.

7. The apparatus as in claim 6 wherein the vortex is further bounded by the predetermined separation distance between the surface and confinement surface.

8. An apparatus for efficiently impinging fluid onto a surface to remove particles and/or heat from the surface, the apparatus comprising:

a plurality of tilted annular jets arranged around a common axis providing a radial and a tangential air flow component, wherein each tilted annular jet comprises a tilt angle with respect to a standing vortex set based on a predetermined flow rate ratio;

a circular vacuum port for providing negative air pressure; and wherein the circular vacuum port suction and the plurality of tilted annular jets are oriented at an acute radial angle relative to the common axis to induce the standing vortex with a high shear stress region tangential to the surface to efficiently remove the dust particles and/or maximize heat transfer away from the surface; wherein the vortex is bounded by streamlines emanating from the plurality of annular tilted jets; and a confinement surface parallel to the surface, wherein the confinement surface is separated from the surface by a predetermined distance.

9. The apparatus as in claim 8 wherein the tilt angle comprises:

substantially 60 degree tangential component; and substantially 15 degree radial component.

* * * * *